US005958175A

United States Patent [19]

Elharrar et al.

[11] Patent Number: 5,958,175

[45] Date of Patent: Sep. 28, 1999

[54] LABELLING MACHINE

[76] Inventors: Nessim Elharrar, 7, rue Mohamed Diouri, Casablanca, Morocco; Premysl Hartman, 350 Route de Nouaceur, Bouskoura, Morocco

[21] Appl. No.: 08/975,664

[22] Filed: Nov. 21, 1997

[30] Foreign Application Priority Data

Dec. 16, 1996 [FR] France ..... 96 15444

[51] Int. Cl.[6] ..... B65C 9/18; B65C 9/40

[52] U.S. Cl. ..... 156/361; 156/351; 156/541; 156/574; 156/579; 156/DIG. 33; 156/DIG. 45

[58] Field of Search ..... 156/556, 361, 156/355, 523, 486, 492, 540, 541, 542, 579, 351, 574, DIG. 33, DIG. 45

[56] References Cited

U.S. PATENT DOCUMENTS 3,405,021 10/1968 Marano ..... 156/542 X 4,867,833 9/1989 McCoy ..... 156/361

FOREIGN PATENT DOCUMENTS 2089274 4/1971 France .

2619079 8/1987 France .

*Primary Examiner*—Curtis Mayes

*Attorney, Agent, or Firm*—Dowell & Dowell, P.C.

[57] ABSTRACT

A machine for applying labels distributed uniformly on a strip to items which includes a swinging arm mounted on a support for engaging the items and a drum for driving the strip of labels. The drum is rotated incrementally by a drive mechanism and means are provided for controlling the drive mechanism and for detecting movement of the arm by engagement with an item. The means for detecting movement of the arm detect the initial movement of the arm to thereby initiate the means for controlling the drive mechanism to index the drum through one complete step thus advancing a label for application to the item.

9 Claims, 4 Drawing Sheets

LABELLING MACHINE

BACKGROUND OF THE INVENTION

1. Field of the Invention

The present invention relates to machines for applying, to items, labels which are distributed uniformly on a wound strip, comprising, mounted on a support plate, a swinging arm for detecting the items, a drum for driving the strip, the drum being rotated stepwise by a drive device, means of controlling the drive device, means of detecting the angular movement of the arm, and means, associated with the arm and controlled by the movement of the strip, of transferring the labels from the strip onto the corresponding items.

The invention applies more particularly to automatic machines intended to apply labels to items of varying shape, especially fruit or vegetables.

2. History of the Related Art

A machine of this kind is described, for example, in patent application FR-A-2,619,079. In this application, a lever connected by one of its ends to the detection arm acts directly on a solenoid valve that controls the drive device.

In these machines, which are placed in packaging stations or are portable and used manually, an item passing under the detection arm acts so as to raise this arm and the means of detecting the movement of the arm trigger, via the control means, the driving of the strip and the application of a label to the item detected.

However, in current machines, the detection arm needs to be moved through quite a large angle to trigger the labelling of the item which means that when placed in packaging stations, these machines are not capable of labelling all the items that raise the arm.

What is more, the manual use of these machines requires a certain amount of physical strength to be able to trigger labelling of all the items, and these machines therefore do not allow labelling at a high rate.

Furthermore, when the drive device comprises a ratchet wheel operated by a member that moves back and forth, especially one that consists of a rod connected, for example, to the piston of a pneumatic ram or to the plunger of an electromagnet, the detection arm has to fall back through quite a large angle to cause the rod to return to the position in which it is ready for labelling, which means that these machines are not capable of labelling two items which are close together, and this further limits the labelling rate for any type of use.

SUMMARY OF THE INVENTION

The object of the present invention is to overcome the aforementioned drawbacks by creating a machine for applying labels to items which is capable of labelling all the items that move the detection arm irrespective of their size and the labelling rate.

For this, the subject of the invention is a machine for applying, to items, labels which are distributed uniformly on a wound strip, comprising, mounted on a support plate, a swinging arm for detecting the items, and a drum for driving the strip, whereby the drum is rotated stepwise by a drive device. Means are provided for controlling the drive device, and means are also provided for detecting the angular movement of the arm. Means are also associated with the arm and controlled by the movement of the strip, for transferring the labels from the strip onto the corresponding items. The machine is characterized in that the means of detecting the angular movement are means of detecting the beginning of the angular movement of the arm. These means are connected to the control means so that as the arm starts to move in one direction, they will trigger the driving of the drum through one complete step and thus label of the item detected by the arm.

According to particular embodiments, the machine comprises one or more of the following features:

- the means of detecting the angular movement comprise a sensor that senses the beginning of the angular movement and is connected to the means of controlling the drive device, a lever for detecting the movement of the arm articulated to the arm by means of a pin, a stop that fixes the initial position of the free end of the lever for detecting the movement practically in contact with the said sensor, and means of coupling the arm and the lever for detecting the movement of the arm, forming a friction clutch that can be disengaged when the lever for detecting the movement of the arm comes into contact either with the sensor or with the stop;
- the coupling means comprise an elastic member for maintaining frictional contact between the detection arm and the detection lever pivoting about the pin, the elastic member and the contacting surfaces of the detection arm and of the lever for detecting the movement of the arm thus constituting the friction clutch;
- the sensor comprises a push-button switch with a short travel placed facing the swinging end of the member that transmits the movement and connected to the control means;
- the drive device comprises a ratchet wheel driving the drum, the ratchet wheel being rotated by a member that moves back and forth, and a sensor for sensing that the ratchet wheel has executed a complete step is connected to the control means so that they will trigger the return of the member that moves back and forth to its stand-by position ready to label the next item;
- the sensor which senses that the ratchet wheel has executed a complete step is a sensor that the member that moves back and forth has come to the end of its travel;
- the member that moves back and forth is connected to the piston of a pneumatic ram and the control means comprise a data-processing unit, the inputs of which are connected to the sensor of the beginning of the angular movement and to the sensor that the ratchet wheel has executed a complete step, and a solenoid valve for controlling the pneumatic ram, this valve being connected to the outputs of the data-processing unit; and
- the direction that triggers labelling is the upward direction of rotation of the detection arm.

BRIEF DESCRIPTION OF THE DRAWINGS

The invention will be better understood from reading the description which will follow, which is given merely by way of example and made with reference to the appended figures in which.

DETAILED DESCRIPTION OF THE PREFERRED EMBODIMENT

Figure 1:
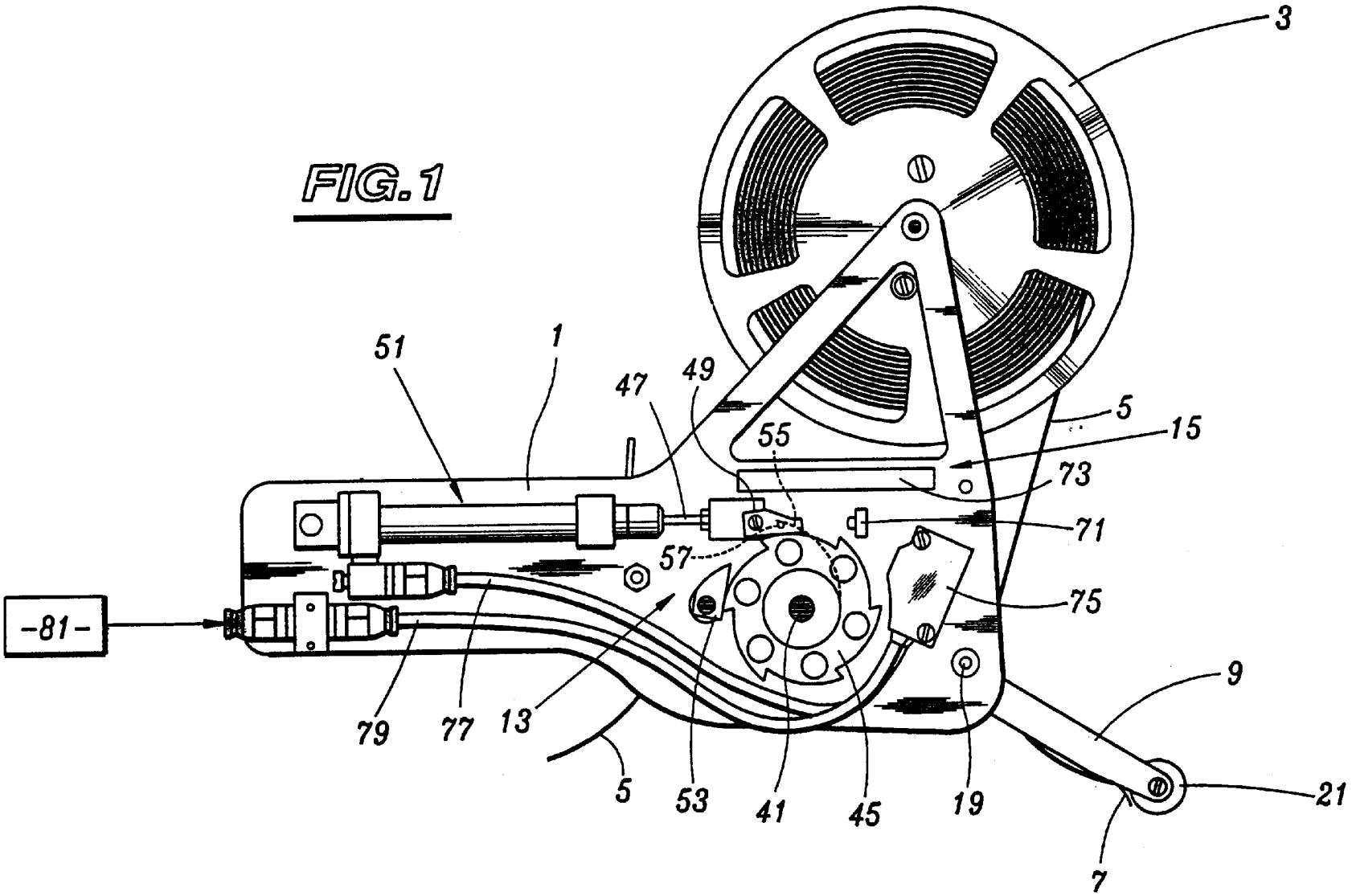
FIGS. 1 and 2 are two side views showing two opposite sides of a labelling machine according to the invention.
Figure 2:
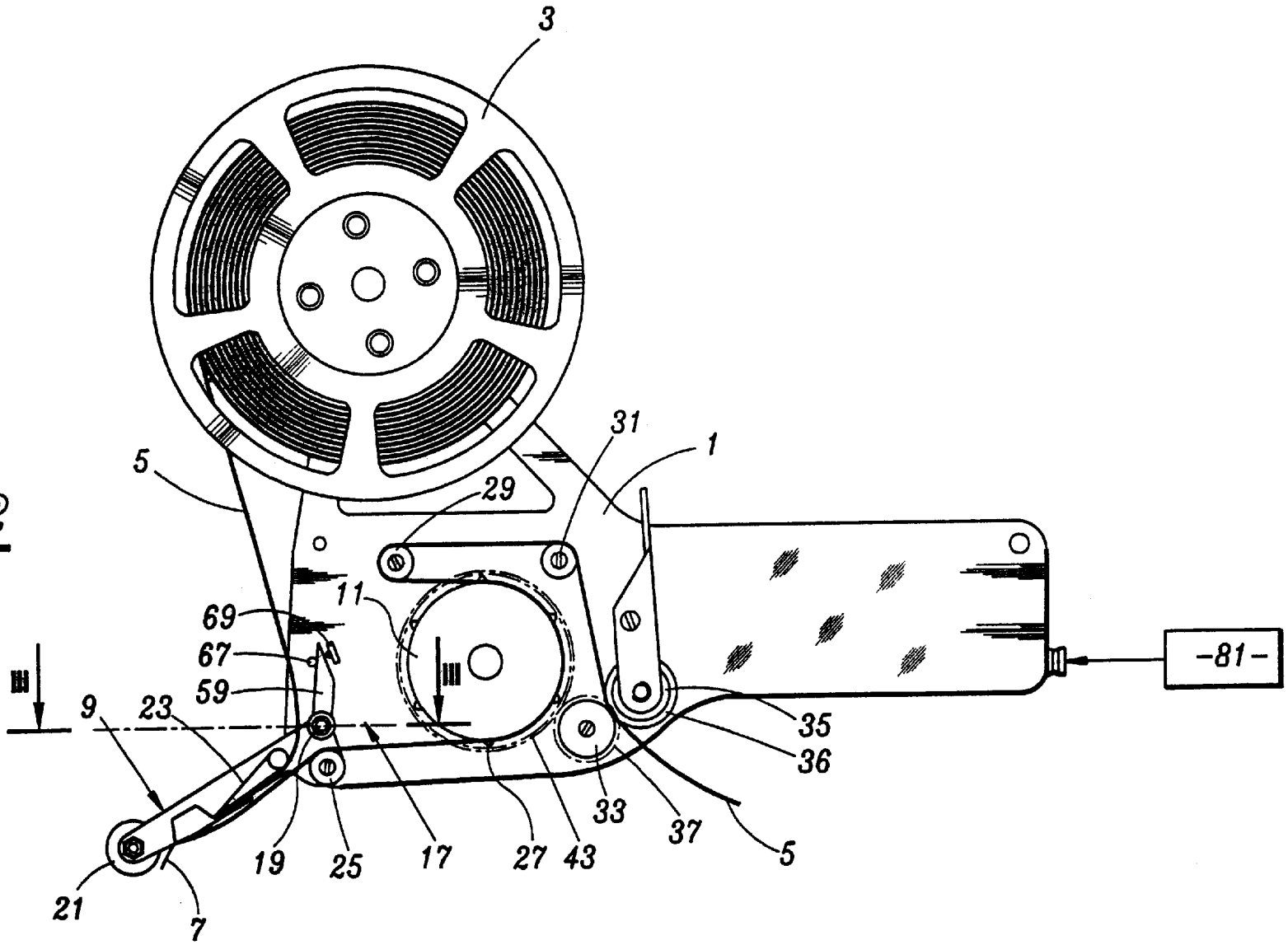

FIGS. 1 and 2 depict a labelling machine according to the invention which comprises, on a support plate 1, a reel 3 that pays out a label backing strip 5 which at regular intervals has labels 7, an arm 9 for detecting the items, a drum 11 for driving the strip, a drive device 13, means 15 of controlling the drive device 13 and means 17 of detecting the movement of the detection arm 9.

The detection arm 9 is mounted so that it can swing about a pin 19 at the front end of the plate 1. It consists of a bent-up fitting for guiding the strip. At its free end, which is outside the plate 1, it has a running roller 21 and a guide finger 23.

The bent-up fitting and the running roller 21 constitute the means of transferring the labels onto the items, the operation of which is explained later.

The strip 5, starting from the reel 3, passes under the guide finger 23 and follows the guide path, then it folds itself at the free end of the detection arm 9 to run under this arm following a path which is more or less parallel to the guide path. It then passes over an idling roller 25 mounted on the fitting that forms the arm 9 then over the strip-driving drum 11. The strip 5 has uniformly distributed transverse perforations in which pegs 27 on the drum 11 engage so as to hold the strip on the drum as it is being wound onto the latter. The strip then passes over two idling rollers 29, 31 then between two rollers 33, 35 secured to two meshing cogs 37, just one of which has been depicted. The roller 35 has a ring 36 made of rubber or some other flexible material which presses against the strip 5 to push it out of the plate 1.

The drum 11 is secured to a shaft 41 mounted so that it can rotate on the plate 1 and a cog 43 that rotates as one with the drum and is fastened to the shaft between the drum and the plate.

The drive device 13 comprises a ratchet wheel 45 secured to the shaft 41 which passes through the plate, a rod 47 carrying a pawl 49 at one of its ends and connected via its other end to the piston of a pneumatic ram 51. The pneumatic ram may, for example, be of the double-acting type or of the type that has a return spring. A non-return catch 53 is fixed to the plate 1 to prevent the wheel 45 from rotating in the other direction.

The pawl 49 is kept pressed against a peripheral surface of the wheel 45 by a leaf spring 55 which presses on a finger 57 connected to the pawl.

Figure 3:
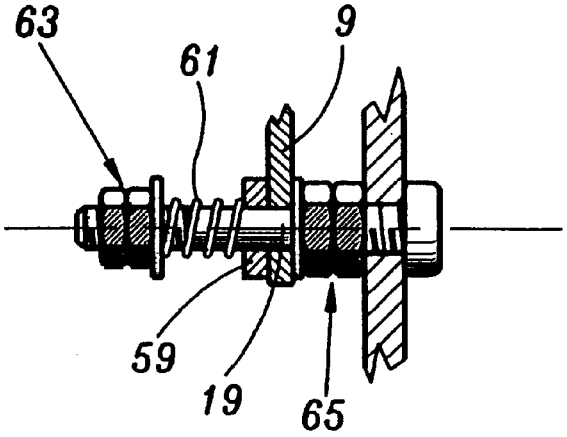
FIG. 3 is a diagrammatic partial view in section on III—III of FIG. 2.

FIG. 3 more particularly illustrates the structure of the means 17 of detecting the movement of the arm. They comprise a lever 59 for detecting the movement of the arm, mounted via one of its ends so that it can rotate about the pin 19 on the same side of the plate 1 as the arm 9 and pressed against the latter. A coil spring 61, slipped over the pin 19 and resting on a nut/lock-nut/washer assembly 63 keeps the lever 59 in frictional contact with the arm 9, itself prevented from translational movement by a nut/lock-nut/washer assembly 65.

The free end of the lever 59 can swing between a stop 67 (FIG. 2) connected to the support and a short-travel push-button sensor 69. The relative position of the stop 67 and of the sensor 69 is such that the lever 59 can swing through a small travel that corresponds to the travel to depress the push-button, between an initial position in which the end of the lever is in contact with the stop 67 and an active, detection, position in which the end of the lever completely depresses the push-button 69. In practice, the initial position of the free end of the lever 59 is practically in contact with the sensor 69.

Incidentally, a push-button switch 71 is positioned at the end of the travel of the pawl on the plate 1 and is designed to be depressed by the pawl 49. It thus constitutes a sensor that the ratchet wheel 45 has executed a complete step.

The means 15 of controlling the drive device comprise a data-processing unit 73 and a three-way/two-position solenoid valve 75. One line is connected by a power line 77 to the opposite end of the ram to the rod, and the other line is connected by a line 79 to an air supply 81.

Figure 4:
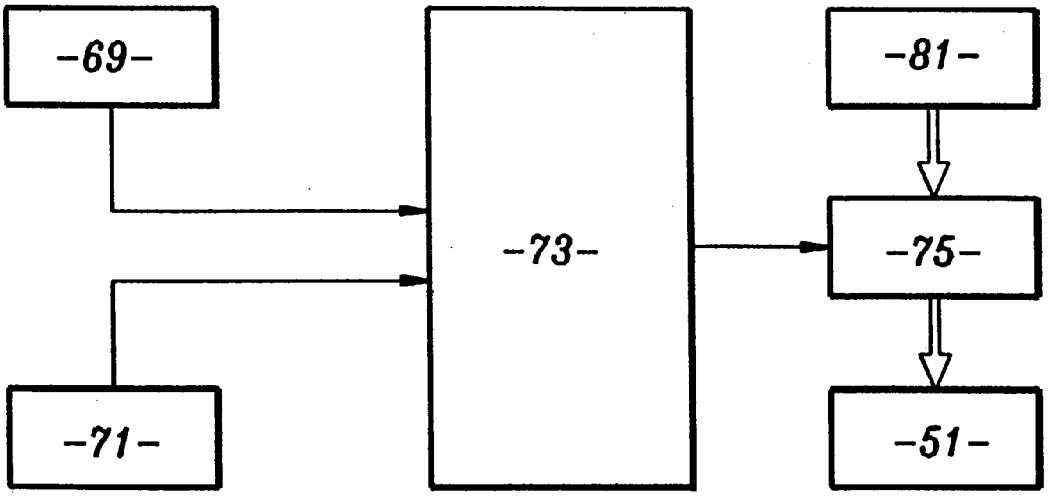
FIG. 4 is a block diagram showing the various connections of the control device of the machine of FIG. 1.

The two sensors 69 and 71 are connected to the inputs of the data-processing unit 73 as shown in FIG. 4. The data-processing unit 73 comprises a microprocessor and means of storing data and programs. The output of the data-processing unit 73 is connected to the solenoid valve 75. The microprocessor is programmed in such a way that it can make the machine operate in the way explained later with reference to FIGS. 4 and 5.

The way in which the machine operates will be described in the case of use at a packaging station. It is then fixed above a means of conveying the items, a conveyor belt for example, which brings the items into contact with the arm.

The way in which the drive device operates is as follows: the opening of the solenoid valve operates the ram 51, the rod 47 then moves and, via the pawl 49, pushes the ratchet placed facing it, thus rotating the wheel 45, the drum 11, the cog 43 and the roller 35 via the cog associated with it. This drive device is therefore capable of making the strip move along the predetermined path for pushing it out thanks to the rubber ring 36 which presses against the roller 33.

A label 7 is transferred when an item is in contact with the arm 9 and when the strip is made to move, thanks to the turn-back point on the path which causes a label to become detached. The roller 21 then applies the label 7 to the item in contact with the arm. This method of transfer is conventional.

The way in which the device 17 for detecting the movement of the arm operates is as follows. The spring 61 maintains frictional contact between the arm 9 and the lever 59, thus creating a friction clutch. The two parts 9 and 59 therefore engage when the amount of torque transmitted is below a limiting frictional torque that is determined by the tension in the spring 61. The arm 9 and the lever 59 are disengaged as soon as the torque transmitted exceeds this amount.

When the arm is in its initial rest position, that is to say when it is not raised, the lever 59 rests against the stop 67. As soon as an item starts to move the arm, the lever 59 encounters no resistive force and the torque transmitted is therefore zero, the arm 9 and the lever 59 therefore move as one until the lever 59 comes into contact with the push-button of the sensor 69. The spring tension is chosen to be high enough for the friction clutch to transmit the torque needed to depress the short-travel push-button. As soon as the push-button has been depressed, the lever 59 is prevented from rotating. The limiting torque is exceeded which means that the arm 9 and the lever 59 become disengaged. The arm 9 then continues its angular movement until it reaches the top of the item. Thanks to the relative position of the stop 67 and of the sensor 69, the push-button is depressed as soon as the arm starts to rotate upwards. When the swinging end of the arm begins to come back down, this arm drives the lever 59 which no longer encounters any obstacle as it returns to the stop 67. The arm 9 and the lever 59 are therefore engaged until the lever 59 comes up against the stop 67. The push-button is therefore released right at the beginning of the downwards angular movement of the arm. The arm and the lever are therefore disengaged and the arm can come back down into its initial position while the lever is kept by the stop close to the sensor ready to detect the beginning of the next upwards movement of the arm.

Figure 5:
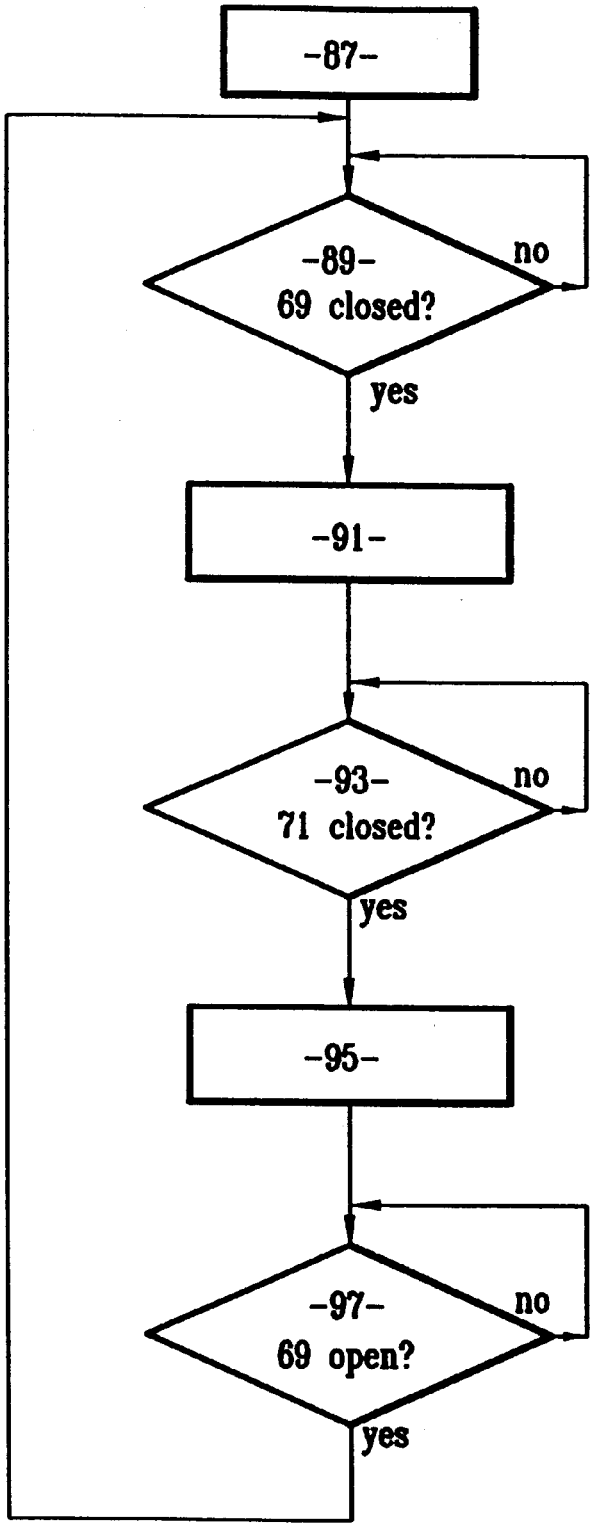
FIG. 5 is a flow chart illustrating the operation of the machine of FIG. 1.

The way in which the machine as a whole operates will be described with reference to FIG. 5. To make this description easier, the expression "sensor open" denotes the condition in which the push-button of the sensor is released and the expression "sensor closed" denotes the condition in which the push-button is depressed. The machine is assumed to start from a condition 87 in which the sensors 69 and 71 are open, the pawl is in its initial stand-by-for-labelling position, that is to say fully to the left in FIG. 1, the solenoid valve 75 thus being closed. The step 89 is a test that the sensor 69 is closed.

The test is reiterated for as long as this sensor is open, that is to say for as long as the arm has not detected an item.

If this sensor is closed, we move on to step 91 which commands the solenoid valve 75 to open. This causes activation of the drive device to drive the drum through a complete step. Thus, as soon as an item raises the arm 9, a label starts to be applied to it.

The next step 93 is a test that the sensor 71 is closed. This step is reiterated for as long as this sensor is open, that is to say for as long as the pawl has not reached the end of its travel. When the sensor 71 is closed, that is to say when the pawl has reached the end of its travel, we pass on to the next step 95 which commands the solenoid valve 75 to close and therefore the pawl to return to its initial position. This return is made possible by the line 79 being vented via the third line of the solenoid valve 75.

The test 93 makes sure that a piece of fruit is labelled as soon as it raises the arm, because the sensor 71 needs to be closed to interrupt the driving of the strip. What is more, the solenoid valve is closed as soon as the pawl reaches the end of its travel, and this allows the pawl to return straight away to its stand-by-position for further labelling without it being necessary to wait for the arm 9 to return to its initial position.

The invention therefore makes it possible to obtain higher labelling rates.

The next step 97 is a test on the activation of the sensor 69. This step is reiterated as long as the sensor is closed, that is to say as long as the item that has just been labelled is still under the arm. As soon as it opens, that is to say as soon as the item that has just been labelled has moved beyond the arm, we return to step 89.

This means that it is necessary to wait for the arm to begin to come back down before further labels can be applied to items, and this prevents two labels from being affixed to the same item. What is more, the arm need merely begin to come back down to authorize further labelling. It is therefore possible to label two items that are very close together, a situation which corresponds to a brief drop followed by a brief rise of the arm. In these conditions, the arm does not have to return to its initial position as was the case in the state of the art in order to allow further labels to be affixed.

The operation has been described in the case of use in a packaging station. The operation is similar when used manually, except that the user brings the detection arm onto the item.

The present invention therefore makes it possible to label all the items detected by the arm 9 at a rate which is limited merely by the speed at which the ram 51 and more generally the drive device 13 can move.

We claim:

1. An apparatus for applying labels to items wherein the labels are distributed uniformly on a wound strip comprising;

a swinging arm pivotally mounted on a support for movement in a detection direction by engagement with the items, a drum for driving the strip, drive means for rotatably indexing said drum in a step-by-step manner, control means for controlling said drive means to index said drum, detection means mounted for detecting movement of said arm in the detection direction, means carried by said arm for transferring a label from the strip onto an item in engagement with said arm, said detection means including a first sensor mounted adjacent said arm and being operably connected to said control means such that said control means will activate said drive means to advance said strip with said labels thereon upon movement of said arm by contact with an item, a detection lever, said detection lever and said arm being mounted on a pin, a friction clutch drivingly engaging said detection lever to move with said arm, a stop engageable by said detection lever when said lever is in a first position wherein said arm has not been moved in the detection direction, said stop being mounted adjacent said first sensor, said detection lever being moveable from said stop into engagement with said first sensor upon movement of said arm in the detection direction, and said friction clutch being disengaged to permit continued movement of said arm in said detection direction when said detection lever engages said first sensor.

2. The apparatus of claim 1 in which said friction clutch includes an elastic member for engaging said detection lever and said arm in frictional contact relative to one another, and means for adjusting said elastic member.

3. The apparatus of claim 2 in which said first sensor includes a push-button switch, said push-button switch being positioned to be engaged by said detection lever.

4. The apparatus of claim 1 in which said first sensor includes a push button-switch, said push button-switch being positioned to be engaged by said detection lever.

5. The apparatus of claim 1 wherein said arm is moveable in an upwardly vertical direction in said detection direction relative to the items.

6. An apparatus for applying labels to items wherein the labels are distributed uniformly on a wound strip comprising;

a swinging arm pivotally mounted on a support for movement in a detection direction by engagement with the items, a drum for driving the strip, drive means for rotatable indexing said drum in a step-by-step manner, control means for controlling said drive means to index said drum, detection means mounted for detecting movement of said arm in the detection direction, means carried by said arm for transferring a label from the strip onto an item in engagement with said arm, said detection means being operably connected to said control means such that said control means will activate said drive means to advance said strip with said labels thereon upon movement of said arm by contact with an item, said drive means including a ratchet wheel connected to said drum, reciprocating means for alternately engaging said ratchet wheel to rotate said drum, and a sensor for determining when said ratchet wheel has indexed a complete step by engagement of said reciprocating means, and said sensor being connected to said control means for controlling the movement of said reciprocating means.

7. The apparatus of claim 6 wherein said reciprocating means is moveable from a first stand-by position to an extended position wherein said ratchet wheel has been advanced one step, second sensor being openable to sense said reciprocating means when in said second position.

8. The apparatus of claim 7 in which said reciprocating means is a piston carried by a pneumatic ram, said control means including a data-processing unit having an input connected to said sensor, and said control means including a solenoid valve for controlling said pneumatic ram, said solenoid valve being connected to outputs of said data-processing unit.

9. The apparatus of claim 6 in which said reciprocating means is a piston carried by a pneumatic ram, said control means including a data-processing unit having an input connected to said sensor, and said control means including a solenoid valve for controlling said pneumatic ram, said solenoid valve being connected to outputs of said data-processing unit.

* * * * *